US008253667B2

(12) United States Patent
Sunohara

(10) Patent No.: US 8,253,667 B2
(45) Date of Patent: Aug. 28, 2012

(54) DISPLAY CONTROL DEVICE AND METHOD OF CONTROLLING SAME

(75) Inventor: Makoto Sunohara, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1052 days.

(21) Appl. No.: 12/213,561

(22) Filed: Jun. 20, 2008

(65) Prior Publication Data

US 2009/0009452 A1 Jan. 8, 2009

(30) Foreign Application Priority Data

Jul. 6, 2007 (JP) ..... 2007-178110

(51) Int. Cl.
*G09G 3/36* (2006.01)

(52) U.S. Cl. ..... 345/87

(58) Field of Classification Search ..... None
See application file for complete search history.

(56) References Cited

U.S. PATENT DOCUMENTS

2002/0097207 A1* 7/2002 Pfeiffer et al. ..... 345/87
2005/0270262 A1* 12/2005 Oh ..... 345/89
2006/0238552 A1* 10/2006 Chuang et al. ..... 345/690
2006/0279505 A1* 12/2006 Nagato et al. ..... 345/98
2007/0132696 A1 6/2007 Yamashita

FOREIGN PATENT DOCUMENTS

JP 5-19719 1/1993
JP 2006-349720 (A) 12/2006
JP 2007-163713(A) 6/2007

* cited by examiner

*Primary Examiner* — Alexander Eisen
*Assistant Examiner* — Matthew Yeung
(74) *Attorney, Agent, or Firm* — McGinn IP Law Group, PLLC

(57) ABSTRACT

In accordance with one embodiment of the invention, a display control device includes a driving circuit driving pixels based on successively inputted display data; and a drive mode control circuit determining an operation mode of the driving circuit based on the difference value between first display data among the display data and second display data among the display data, the first display data being the (N+1)th display data, and the second display data being the Nth display data.

14 Claims, 8 Drawing Sheets

DISPLAY CONTROL DEVICE AND METHOD OF CONTROLLING SAME

BACKGROUND OF THE INVENTION

1. Field of the Invention

The present invention relates to a display control device and a method of controlling the same. In particular, the present invention relates to a display control device having periods during which a display device is driven by different current driving capabilities, and a method of controlling the same.

2. Description of Related Art

In recent years, a liquid crystal display panel such as a TFT (Thin Film Transistor) display panel has been often used as a display device. In the liquid crystal display panel, data is displayed, in general, by driving pixels arranged in a lattice pattern by a gate driver and a source driver. The gate driver has the same number of outputs as the number of rows of the pixels of the liquid crystal display panel, and selects a row of the pixels where data is displayed. The source driver has the same number of outputs as the number of columns of the pixels of the liquid crystal display panel, and drives the source of pixels located in respective columns in accordance with the display data.

That is, in a liquid crystal display panel, an image is displayed on a row-by-row basis by driving pixels located in the row that is selected by the gate driver by the source driver in accordance with display data. Furthermore, the image is displayed throughout the screen by successively shifting the selected column. Japanese Unexamined Patent Application Publication No. 05-19719 discloses one example of the driving device for a liquid crystal display panel.

FIG. 9 shows a block diagram of a driving device 100 in related art disclosed in Japanese unexamined patent Application Publication No. 05-19719. As shown in FIG. 9, the driving device 100 in the relate art includes a liquid crystal display panel 103, and a source driver 101 and a gate driver 102 to drive the liquid crystal display panel 103.

Pixels are arranged in a lattice pattern in the liquid crystal display panel 103. The gate driver 102 drives the gates of these pixels, and selects pixels where data is displayed. Incidentally, the gate driver 102 has the same number of outputs as the number of rows of pixels of the liquid crystal display panel 103. The source driver 101 turns on selected pixels in desired colors in accordance with display data by applying voltages that change based on the display data to the sources of the selected pixels. Incidentally, the source driver 101 has the same number of outputs as the number of columns of pixels of the liquid crystal display panel 103.

Furthermore, the source driver 101 includes a data driving portion 104, a drive voltage control circuit 105, and a switching signal generating portion 106. The data driving portion 104 generates voltage, which is applied to the pixels selected by the gate driver 102, from the data to be displayed. The drive voltage control circuit 105 generates voltage to drive the pixels based on the outputs from the data driving portion 104 and switching signal generating portion 106. The switching signal generating portion 106 generates one-shot pulses based on the horizontal synchronizing signal Hsync.

FIG. 10 shows a timing chart of the operation of the driving device 100 in the related art. Incidentally, FIG. 10 shows the outputs of the gate driver only for four rows, and the output of the source driver only for one column. As shown in FIG. 10, the gate driver 102 selects one row of pixels at each of the timings T10-T16. The drive voltage control circuit 105 of the source driver 101 generates a drive signal for each of the selected row of pixels. This drive signal has voltage equivalent to the sum of the output of the data driving portion and the switching signal (one-shot pulse), which is generated at the timing when the output of the data driving portion starts to change. That is, the output of the drive voltage control circuit 105 has a higher voltage value over a certain period Ta, which starts at the timing when the output of the data driving portion starts to change.

In this manner, it enables the signal to change more rapidly at the phase where the driving of pixels starts. That is, it can change the voltage that is applied to pixels by the source driver 101 to a predetermined voltage at earlier timing. By stabilizing the drive voltage more rapidly, it can drive a larger number of pixels in a short time. This fact becomes more effective when it drives a high definition liquid crystal display panel having a larger number of pixels.

Meanwhile, the desire to drive a liquid crystal display panel with low power consumption has been growing in recent years. Especially, the desire to reduce power consumption during the operation mode of a liquid crystal display panel that is mounted on a mobile device has been growing. However, there is a problem in the driving device 100 in the related art that since the drive voltage at the timing when the driving of pixels starts is higher than the required voltage in accordance with the display data, the power consumption by this part of circuit becomes larger.

Furthermore, since the drive voltage at the timing when the driving of pixels starts needs to be higher than the required voltage in accordance with the display data, the operating power supply voltage also needs to be higher in the driving device 100 in the related art. This imposes another problem that when the operating power supply voltage becomes higher, the power consumption of the drive voltage control circuit 105 also becomes higher.

SUMMARY

In accordance with one embodiment of the invention, a display control device includes a driving circuit driving pixels based on successively inputted display data, and a drive mode control circuit determining an operation mode of the driving circuit based on the difference value between first display data among the display data and second display data among the display data, the first display data being the (N+1)th display data, and the second display data being the Nth display data.

In accordance with another embodiment of the invention, a method of controlling a display control device having a driving circuit to drive pixels arranged in the column direction of a display device having pixels arrange in a lattice pattern, includes determining an operation mode of the driving circuit based on the difference value between first display data among display data and second display data among the display data, the first display data being display data in the (N+1)th row, and the second display data being display data in the Nth row.

In accordance with one embodiment of the present invention, the display control device and the method of controlling the same can control the switch timing of the operation mode based on the difference value between a pixel that is driven at that moment and a pixel that is driven at the previous timing. In this manner, for example, in the case the difference between the display data of a pixel that is currently driven and the display data of a pixel that is driven at the next time is small, the driving circuit can shorten the period during which the driving circuit operates in a mode where it drives with high current driving capability when the driving circuit drives that next pixel. On the other hand, in the case the difference between the display data of a pixel that is currently driven and the display data of a pixel that is driven at the next time is large, the driving circuit can extend the period during which the driving circuit operates in a mode where it drives with high current driving capability when the driving circuit drives that next pixel.

In this manner, when the difference value between two display data that are displayed in succession is small, the operating time of the mode where it drives with low current driving capability and low power consumption becomes longer. That is, the display control device in accordance with one embodiment of the present invention can reduce the power consumption. On the other hand, when the difference value between two display data that are displayed in succession is large, the operating time of the mode, where the current driving capability is large and thereby the voltage applied to a pixel can be changed more rapidly, becomes longer. In this manner, the display control device in accordance with one embodiment of the present invention can ensure the precise driving of pixels even when the difference value between two display data that are displayed in succession is large.

The display control device in accordance with one embodiment of the present invention can reduce the power consumption for driving a display device while ensuring the precise driving of pixels.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF THE PREFERRED EMBODIMENTS

The invention will now be described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Figure 1:
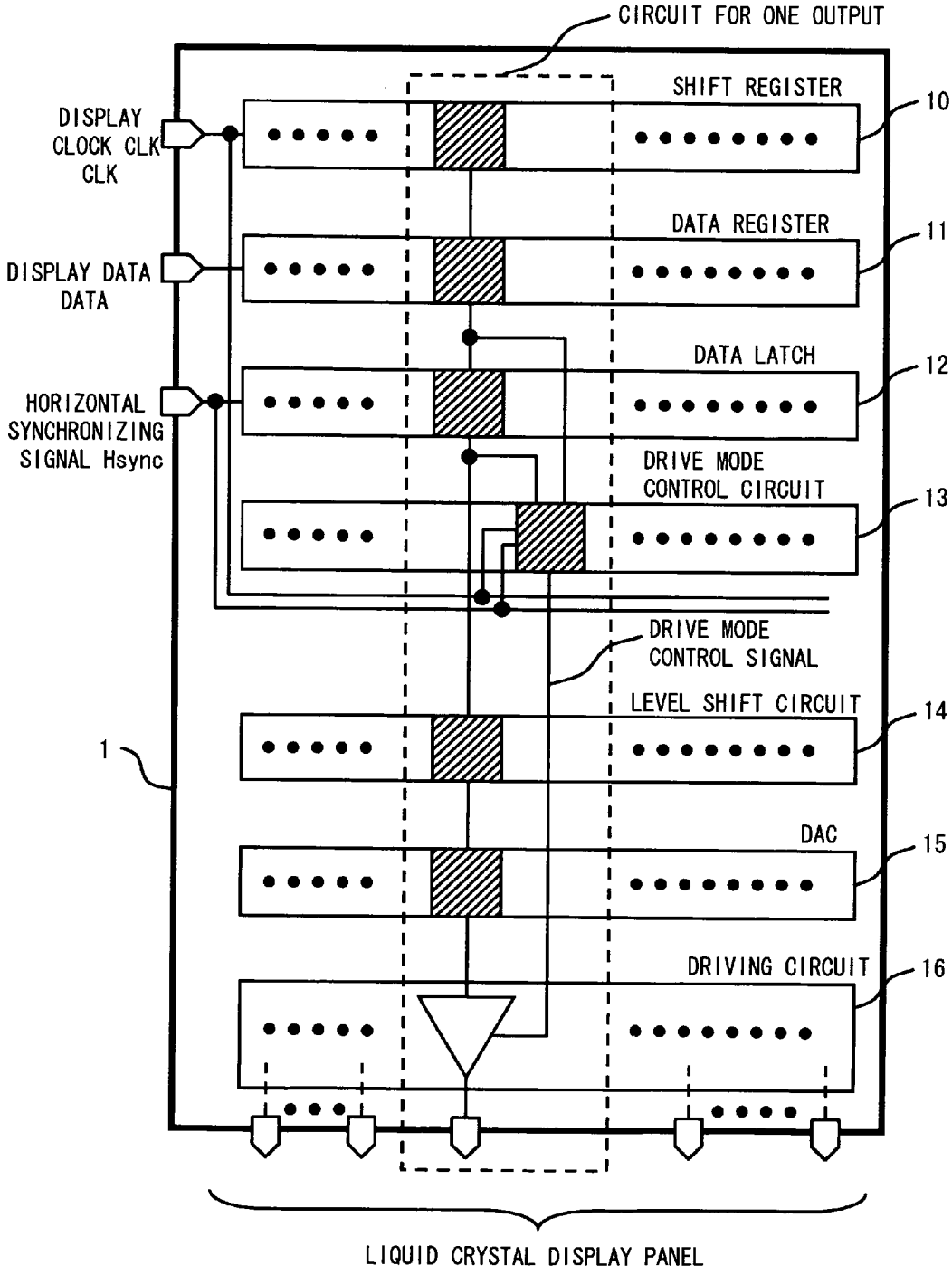
FIG. 1 is a block diagram of a display control device in accordance with a first embodiment of the present invention.

Embodiments in accordance with the present invention are explained hereinafter with reference to the drawings. FIG. 1 shows a block diagram of a display control device 1 in accordance with a first embodiment of the present invention. The display control device 1 in accordance with the first embodiment may operate as a source driver for a liquid crystal display panel having pixels arranged in a lattice pattern. As shown in FIG. 1, the display control device 1 includes a shift register 10, a data register 11, a data latch 12, a drive mode control circuit 13, a level shift circuit 14, a DAC (Digital Analog Converter) 15, and a driving circuit 16.

The shift register 10 is composed of serially-connected flip-flop circuits, and for example, shifts a high-level output to a flip-flop in the next stage in response to the display clock CLK. The data register 11 is composed of a plurality of storage portions to store display data DATA, and, for example, can store display data having a data length of 8 bits. The data register 11 has storage portions corresponding to their respective flip-flops of the shift register 10, and for example, stores display data DATA that is inputted to the storage portions corresponding to the flip-flops outputting high level. The data register 11 also stores first display data (e.g., display data DATA in the (N+1)th row when the driving circuit 16 is driving pixels in the Nth row). In the following explanation, "N" is an integer, and used as a sign to indicate row or column number, or the order of data.

The data latch 12 is composed of a plurality of storage portions to store second display data (e.g., display data DATA in the Nth row when the driving circuit 16 is driving pixels in the Nth row). Furthermore, the data latch 12 takes in the display data DATA from the data register 11 in response to the input of the horizontal synchronizing signal Hsync. Incidentally, data stored in the data latch 12 is, for example, digital data having a data length of 8 bits. The details of the horizontal synchronizing signal Hsync and display data DATA are explained later.

The level shift circuit 14 converts the voltage level of display data stored in the data latch 12. For example, it converts data having amplitude equivalent to the operating power supply voltage of the data latch 12 into data having amplitude equivalent to the operating power supply voltage of the DAC 15. The DAC 15 outputs voltage having an analog value corresponding to the inputted digital data. The driving circuit 16 has sufficient current driving capability to drive pixels connected to its output, and outputs voltage equivalent to the voltage value outputted from the DAC 15. Furthermore, the driving circuit 16 can switch the operation mode in response to the output of the drive mode control circuit 13.

The drive mode control circuit 13 calculates the difference between the value of display data DATA stored in the data register 11 and the value of display data stored in the data latch 12, and determines the operation mode based on this difference. The operation modes include, for example, a first mode (e.g., high power mode HPM) where the driving circuit 16 drives pixels with high current driving capability over a unit period during which the driving of one pixel (row) is carried out, and a second mode (e.g., low power mode LPM) where the driving circuit 16 drives pixels with low current driving capability.

The detail of signal inputted to the display control device 1 is explained hereinafter. In a case where display data DATA is, for example, 8-bit digital data and each pixel is displayed by three colors, i.e., Red (R), Green (G), and Blue (B), a value is established for each of the color elements. This value is used to indicate the intensity of each color element. Furthermore, if each color element has, for example, 256-level grayscale, the value is an integer from 0 to 255. The display control device in accordance with this embodiment has the same number of outputs as the product of the number of pixels and the number of color elements. Furthermore, the display control device has the above-mentioned circuit for each of its outputs, and display data is inputted for each of these circuits.

Furthermore, the horizontal synchronizing signal Hsync is a pulse signal transmitted in a first cycle (scanning switching cycle). For example, the horizontal synchronizing signal Hsync is a pulse signal having low signal level in regard to high level signal. The horizontal synchronizing signal Hsync is a signal specifying the switch timing of the rows of pixels where the display data DATA is displayed. For example, a liquid crystal display panel successively shifts the row where the values of pixels are rewritten every time the pulse of the horizontal synchronizing signal Hsync is inputted. That is, the horizontal synchronizing signal Hsync is a signal used to adjust the synchronization of the rewriting of pixels arranged in horizontal direction in the screen.

While the horizontal synchronizing signal Hsync is the signal used to adjust the synchronization in horizontal direction, a vertical synchronizing signal Vsync is used to adjust the synchronization in vertical direction. In a liquid crystal display panel, the vertical synchronizing signal Vsync is supplied to a gate driver (not shown), which selects the row of pixels where the pixels are rewritten. The vertical synchronizing signal Vsync is a pulse signal transmitted in a second cycle (screen rewrite cycle). For example, the vertical synchronizing signal Vsync is a pulse signal having low signal level in regard to high level signal. Furthermore, the horizontal synchronizing signal Hsync has the same number of pulses as the number of rows of pixels within the period equivalent to the interval between the pulses of the vertical synchronizing signal Vsync. When the vertical synchronizing signal Vsync is inputted, the gate driver selects the first row of pixels. Next, when the horizontal synchronizing signal Hsync is inputted, the gate driver selects the next row of the pixels. Then, when the vertical synchronizing signal Vsync is inputted again, the gate driver selects the first row of the pixels.

The display clock CLK is, for example, a clock signal having a cycle shorter than a value that is calculated by dividing the interval of the horizontal synchronizing signal Hsync by the number of columns of pixels. By using the clock CLK having such cycle, it can store display data for the next row in the data register 11 within the period during which the driving of one row of pixels is carried out.

Figure 2:
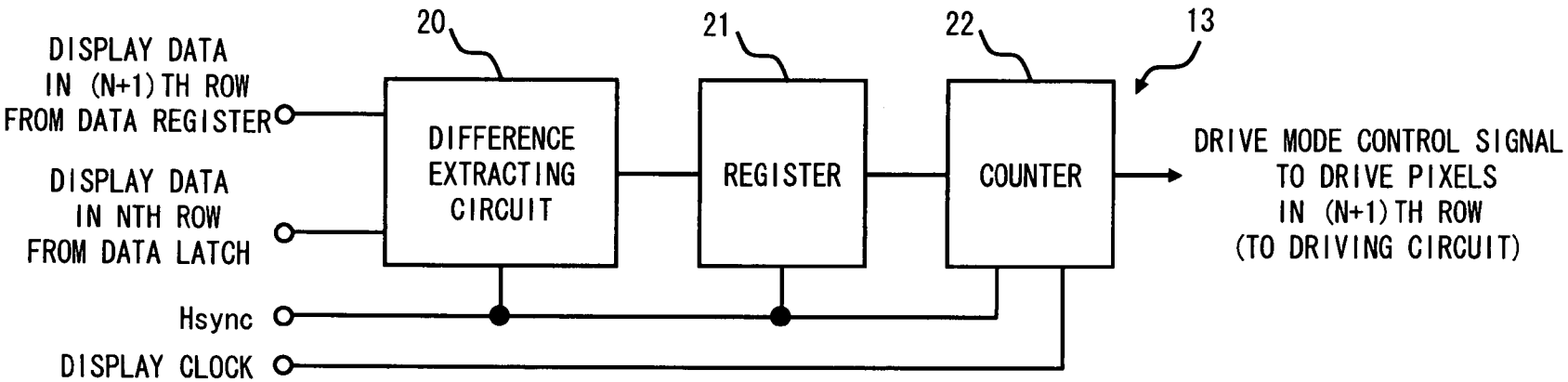
FIG. 2 is a block diagram of a drive mode control circuit in accordance with the first embodiment of the present invention.

The detail of the drive mode control circuit 13 is explained hereinafter. FIG. 2 shows a block diagram of the drive mode control circuit 13. As shown in FIG. 2, the drive mode control circuit 13 includes a difference extracting circuit 20, a register 21, and a counter 22. The difference extracting circuit 20 receives display data in the Nth row (e.g., display data in the row driven by the driving circuit 16 at that moment) from the data latch 12. The difference extracting circuit 20 also receives display data in the (N+1)th row (e.g., display data in the row that is driven by the driving circuit 16 in the next period) from the data register 11. The difference extracting circuit 20 outputs the difference value between the display data in the Nth row and the display data in the (N+1)th row.

The register 21 stores the output of the difference extracting circuit 20 in response to the pulse signal of the horizontal synchronizing signal Hsync. The register 21 retains the stored output of the difference extracting circuit 20 until the next pulse of the horizontal synchronizing signal Hsync is inputted. The counter 22 starts to count clocks of the display clock at the instant when the pulse of the horizontal synchronizing signal Hsync is inputted, and changes the output signal based on the value of the register 21. For example, if the value stored in the register 21 is 128, the counter 22 divides this value by the total levels of the grayscale, i.e., 256 to calculate a coefficient, and further calculates the product of this coefficient and the number of clocks of the display clock that are inputted within the interval between the pulses of the horizontal synchronizing signal Hsync as a count clock value. Then, the counter 22 changes the output at the instant when the count value of the inputted display clock exceeds the count clock value. The counter 22 changes the output by, for example, selecting a high level output or a low level output. The high level output outputted by the counter 22 has voltage equivalent to the power supply voltage. On the other hand, the low level output has voltage value lower than the power supply voltage, and is determined based on the current value consumed by the driving circuit 16 when the driving circuit 16 operates in the low power mode LPM.

Figure 3:
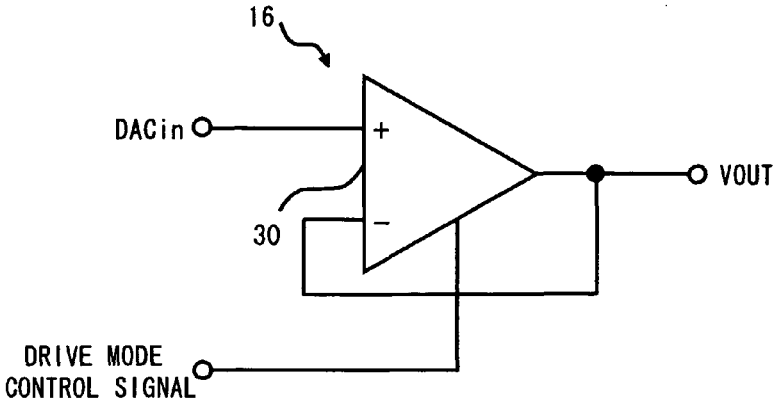
FIG. 3 is a block diagram of a driving circuit in accordance with the first embodiment of the present invention.

The detail of the driving circuit 16 is explained hereinafter. FIG. 3 shows a block diagram of the driving circuit 16. The driving circuit 16 has an amplifier circuit 30. Analog voltage DACin from the DAC 15 is inputted to the non-inverting input terminal "+" of the amplifier circuit 30. The inverting input terminal "−" is connected to an output terminal VOUT. That is, the amplifier circuit 30 acts as a buffer circuit. Furthermore, a drive mode control signal outputted from the drive mode control circuit 13 is inputted to the amplifier circuit 30. The amplifier circuit 30 changes the current driving capability and the current consumption based on the voltage level of this drive mode control signal.

Figure 4:
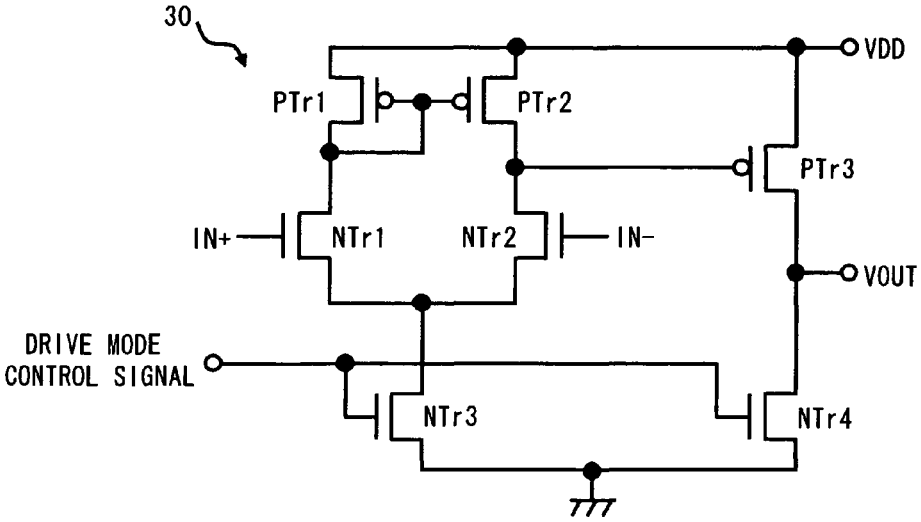
FIG. 4 is a circuit diagram of an amplifier circuit in accordance with the first embodiment of the present invention.

The further detail of the amplifier circuit 30 is explained hereinafter. FIG. 4 shows a circuit diagram of the amplifier circuit 30. As shown in FIG. 4, the amplifier circuit 30 includes NMOS transistors NTr1-NTr4, and PMOS transistors PTr1-PTr3. The NMOS transistors NTr1 and NTr2 constitutes a differential pair, and the gate of the NMOS transistor NTr1 acts as the non-inverting input terminal "+" of the amplifier circuit 30 and the gate of the NMOS transistor NTr2 acts as the inverting input terminal "−" of the amplifier circuit 30. The sources of the NMOS transistors NTr1 and NTr2 are connected with each other, and the NMOS transistor NTr3 is connected between these sources and ground voltage GND. The drive mode control signal is inputted to the gate of the NMOS transistor NTr3.

The PMOS transistor PTr1 is connected between the drain of the NMOS transistor NTr1 and power supply voltage VDD. The gate and drain of the PMOS transistor PTr1 are connected with each other. The PMOS transistor PTr2 is connected between the drain of the NMOS transistor NTr2 and the power supply voltage VDD. The gate of the PMOS transistor PTr2 is connected to the gate of the PMOS transistor PTr1.

Furthermore, the PMOS transistor PTr3 and NMOS transistor NTr4 are connected in series between the power supply voltage VDD and ground voltage GND. The gate of the PMOS transistor PTr3 is connected to the node between the PMOS transistor PTr2 and NMOS transistor NTr2. Meanwhile, the drive mode control signal is inputted to the gate of the NMOS transistor NTr4. Furthermore, the node between the PMOS transistor PTr3 and NMOS transistor NTr4 acts as the output terminal of the amplifier circuit 30.

The current consumption and the current driving capacity of the amplifier circuit 30 are determined based on the voltage level of the drive mode control signal. That is, when the voltage level of the drive mode control signal is high, the current value that is determined by the NMOS transistor NTr3 and NMOS transistor NTr4 becomes larger. Furthermore, when the voltage level of the drive mode control signal is high, and thereby the current value that is determined by the NMOS transistor NTr4 is large, the current flowing through the PMOS transistor PTr3 also becomes larger in response to that. Consequently, the current driving capacity of the amplifier circuit 30 also becomes higher.

On the other hand, when the voltage level of the drive mode control signal is low, the current value that is determined by the NMOS transistor NTr3 and NMOS transistor NTr4 becomes smaller. Furthermore, when the voltage level of the drive mode control signal is low, and thereby the current value that is determined by the NMOS transistor NTr4 is small, the current flowing through the PMOS transistor PTr3 also becomes smaller in response to that. Consequently, the current driving capacity of the amplifier circuit 30 also becomes lower.

Figure 5:
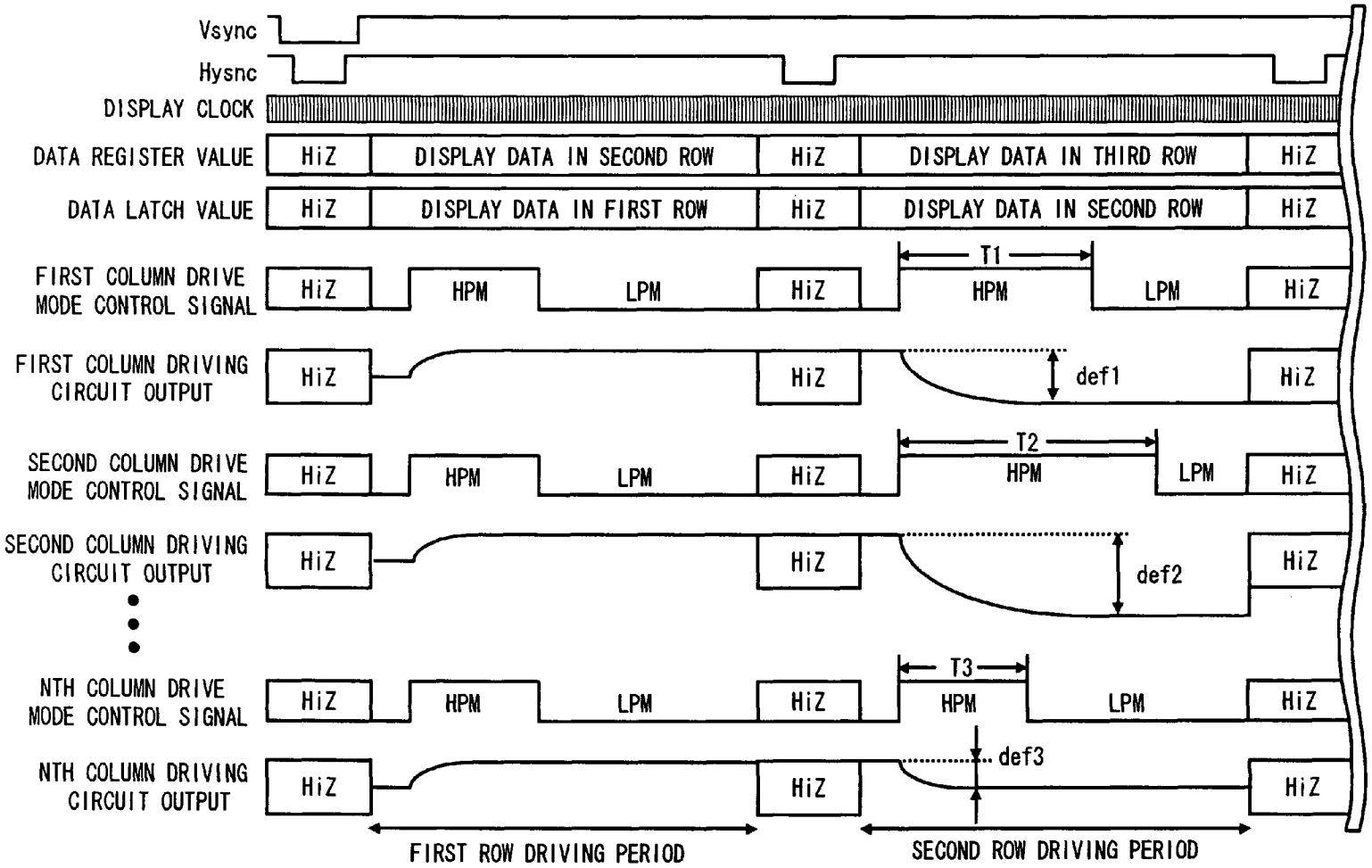
FIG. 5 is a timing chart showing the operation of the display control device in accordance with the first embodiment of the present invention.

The operation of the display control device 1 in accordance with this embodiment is explained hereinafter with reference to the timing chart shown in FIG. 5. In the timing chart shown in FIG. 5, the starting point of the operation is a state where the pulse of the vertical synchronizing signal Vsync is inputted and the gate driver selects the first row of the pixels. Furthermore, FIG. 5 is a timing chart showing a period during which the first and second rows of pixels are driven.

Firstly, the outputs of all drive mode control circuits and all driving circuits become high impedance (HiZ) states at the timing when the pulse of the vertical synchronizing signal Vsync or horizontal synchronizing signal Hsync is inputted. Furthermore, display data representing the values of pixels in the selected first row is stored in the data latch 12 in the period during which the pixels in the first row are driven (first row drive period). Meanwhile, display data representing the values of pixels in the second row is stored in the data register 11.

When the first row drive period starts, each driving circuit drives the pixel, in the high power mode HPM, such that the voltage that is applied to the pixel becomes the voltage corresponding to the display data of the first row. At this point, the period during which the driving circuit 16 operates in the high power mode HPM is determined based on the difference between the starting drive voltage of the driving circuit 16 and the voltage corresponding to the display data.

Next, the period during which the pixels in the second row are driven (second row drive period) is explained hereinafter. Display data representing the values of pixels in the second row is stored in the data latch 12 in second row drive period. Meanwhile, display data representing the values of pixels in the third row is stored in the data register 11.

When the second row drive period starts, each driving circuit drives a pixel, in the high power mode HPM, such that the voltage that is applied to the pixel becomes the voltage corresponding to the display data of the second row. At this point, the period during which the driving circuit 16 operates in the high power mode HPM is determined based on the difference between the display data of the first row and the display data of the second row. In the example shown in FIG. 5, the differences between pixels of the first row and pixels of the second row are expressed by the formula, def2>def1>def3, and the periods during which the driving circuit 16 operates in the high power mode are expressed by the formula, T2>T1>T3. In the above explanation, def1 is the difference between voltage for the pixel in the first row and voltage for the pixel in the second row in the driving circuit 16 of the first column. Def2 is the difference between voltage for the pixel in the first row and voltage for the pixel in the second row in the driving circuit 16 of the second column. Def3 is the difference between voltage for the pixel in the first row and voltage for the pixel in the second row in the driving circuit 16 of the Nth column. Furthermore, T1 is the period during which the driving circuit 16 of the first column operates in the high power mode. T2 is the period during which the driving circuit 16 of the second column operates in the high power mode. T3 is the period during which the driving circuit 16 of the Nth column operates in the high power mode.

As seen from the above explanation, in the display control device 1 in accordance with this embodiment, the larger the difference between the voltage value for pixels driven by the driving circuit 16 at that moment and the voltage value for pixels driven at the previous timing, the longer the period during which they are driven in the high power mode HPM becomes. On the other hand, in the display control device 1 in accordance with this embodiment, the smaller the difference between the voltage value for pixels driven by the driving circuit 16 at that moment and the voltage value for pixels driven at the previous timing, the longer the period during which they are driven in the low power mode LPM becomes. That is, the display control device 1 in accordance with this embodiment can reduce the power consumption of the driving circuit 16 in a state where driving voltage for pixels is stable and the pixels can be driven by low current driving capacity. In this manner, it can reduce the power consumption of the display control device 1 in the operation state.

Furthermore, the display control device 1 in accordance with this embodiment calculates the difference of a pixel of the current display data from a pixel that is driven at the previous timing for each pixel to be driven, and determines the length of the period during which it operates in the high power mode HPM based on the difference value. In this manner, the display control device 1 can reduce the power consumption while carrying out the sufficient driving of pixels in accordance with display data. Furthermore, since the period during which it operates in the high power mode HPM is determined on a pixel-to-pixel basis, the reduction in power consumption can be carried out in more rigorous manner in accordance with display data.

Second Embodiment

A display control device 2 in accordance with a second embodiment of the present invention is generally the same as the display control device 1 in the first embodiment. The display control device 2 in accordance with the second embodiment is different from the first embodiment in the structures of the drive mode control circuit and the driving circuit. The details of a drive mode control circuit 13' and a driving circuit 16' in accordance with the second embodiment are explained hereinafter. Incidentally, the same signs are assigned to the same components of the second embodiment as the first embodiment, and explanations of them are omitted.

Figure 6:
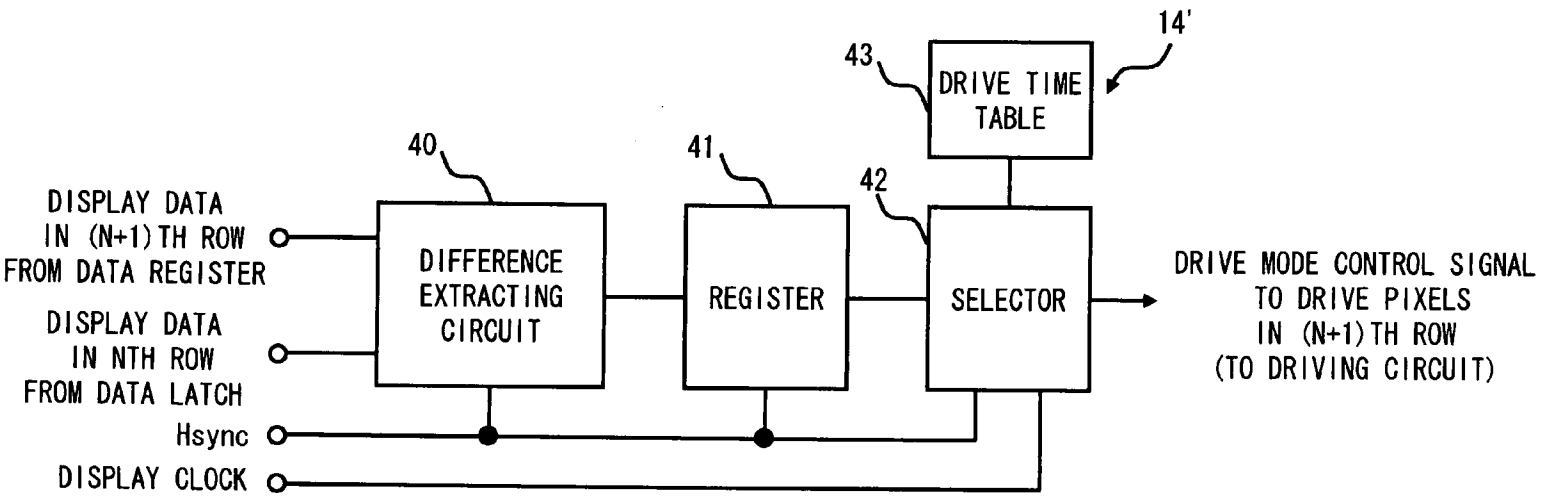
FIG. 6 is a block diagram of a drive mode control circuit in accordance with a second embodiment of the present invention.

Firstly, FIG. 6 shows a block diagram of a drive mode control circuit 13'. As shown in FIG. 6, the drive mode control circuit 13' includes a difference extracting circuit 40, a register 41, a selector 42, and a drive time table 43. The difference extracting circuit 40 and register 41 are substantially the same as the difference extracting circuit 20 and register 21 respectively of the first embodiment. The selector 42 selects and outputs a period, which are stored in the drive time table 43, and during which the driving circuit 16' operates in the high power mode HPM, based on, for example, a values to red in the register 41. Several period values during which the driving circuit 16' operates in the high power mode HPM (operation mode period) are listed for their respective difference values in the drive time table 43. The list of operation mode periods stored in the drive time table 43 may be created by dividing the entire grayscale range into several grayscale ranges, and listing an operation mode period for each of the several grayscale ranges. For example, the entire grayscale range of a pixel may be divided into four grayscale ranges, and an operation mode period is listed for each of the four grayscale ranges. Furthermore, the drive time setting signal, which is outputted from the selector 42, is a digital signal having amplitude from ground voltage to power supply voltage.

Figure 7:
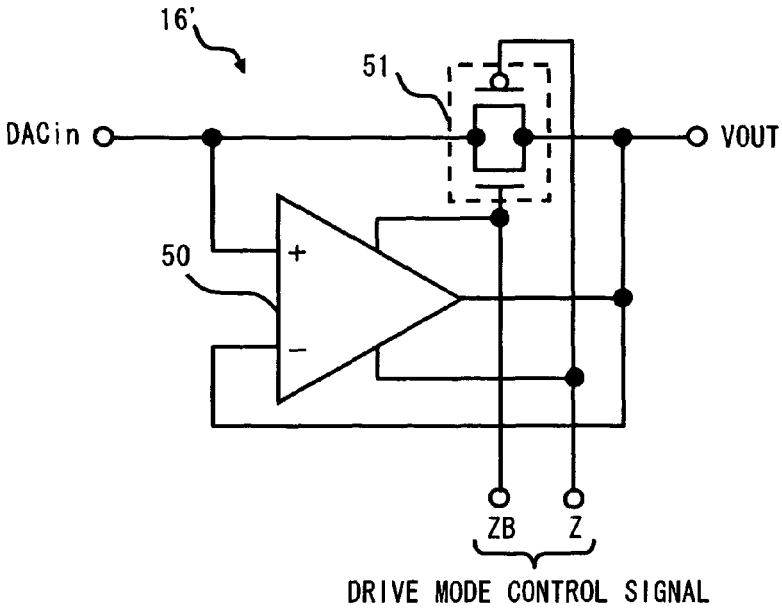
FIG. 7 is a block diagram of a driving circuit in accordance with the second embodiment of the present invention.

Next, FIG. 7 shows a block diagram of the driving circuit 16'. As shown in FIG. 7, the driving circuit 16' has an amplifier circuit 50 and a switch 51. Analog voltage DACin from the DAC 15 is inputted to the non-inverting input terminal "+" of the amplifier circuit 50. The inverting input terminal "–" is connected to an output terminal VOUT. That is, the amplifier circuit 50 acts as a buffer circuit. Furthermore, a drive mode control signal outputted from the drive mode control circuit 13' is inputted to the amplifier circuit 50. The states of the amplifier circuit 50 are switched between an operating state and a stopped state in response to the voltage level of the drive mode control signal.

The analog voltage DACin is also inputted to one terminal of the switch 51, and the switch 51 outputs the analog voltage DACin from the other terminal, which is connected to the output terminal VOUT. The states of switch 51 are switched between a conducting state and a cutoff state in response to the drive mode control signal.

When the drive mode control signal is in the high power mode HPM, the driving circuit 16' brings the switch 51 to the cutoff state, and drives pixels with high current driving capacity through the amplifier circuit 50. On the other hand, when the drive mode control signal is in the low power mode LPM, it brings the amplifier circuit 50 to the sopped state, and drives pixels by bringing the switch 51 to the conducting state. That is, pixels are driven by the DAC 15 in the low power mode LPM. Therefore, the DAC 15 preferably has enough current driving capacity for the low power mode LPM. Incidentally, the driving circuit 16' in accordance with the second embodiment is controlled based on the drive mode control signals Z and ZB, both of which have inverted logics to each other.

Figure 8:
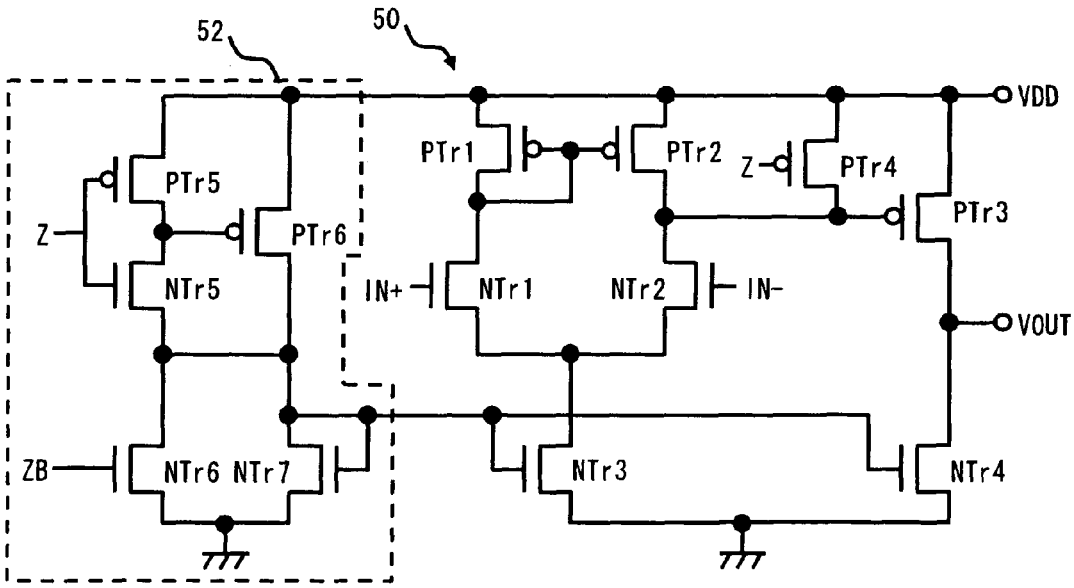
FIG. 8 is a circuit diagram of an amplifier circuit in accordance with the second embodiment of the present invention.
Figure 9:
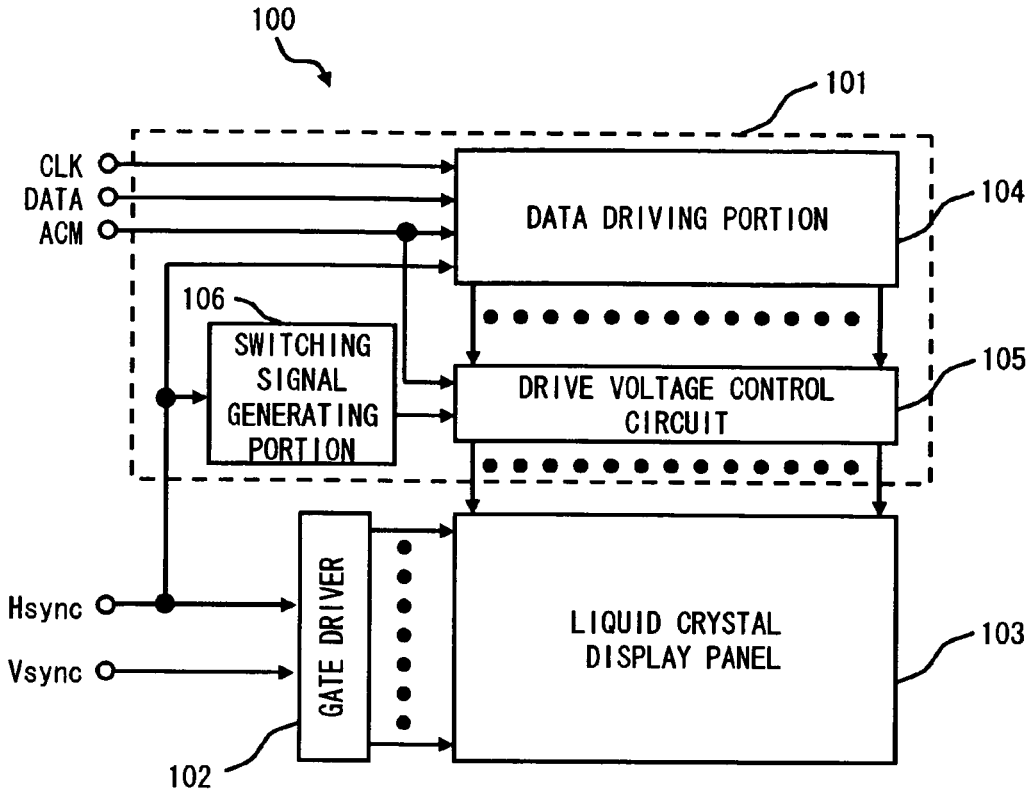
PRIOR ART Fig. 9
FIG. 9 is a block diagram of a driving device in related art.
Figure 10:
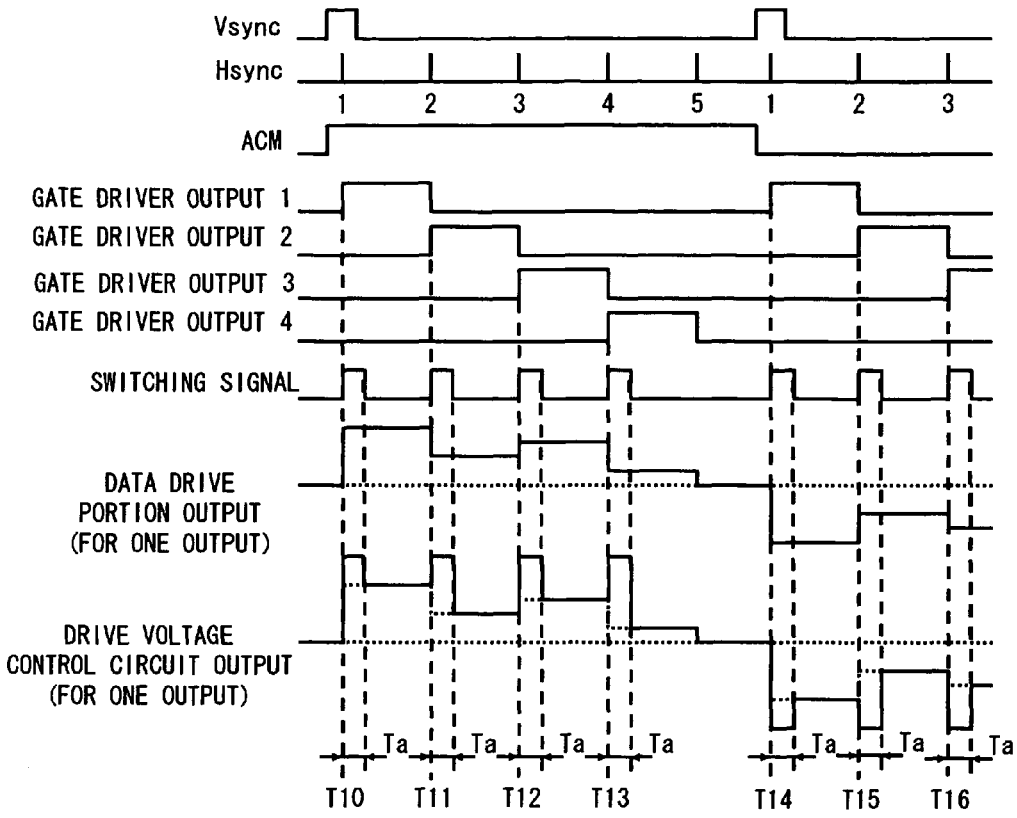
PRIOR ART Fig. 10
FIG. 10 is a timing chart of the operation of the driving device in the related art.

The further detail of the amplifier circuit 50 is explained hereinafter. FIG. 8 shows a circuit diagram of the amplifier circuit 50. As shown in FIG. 8, the amplifier circuit 50 includes a PMOS transistor PTr4 and a current control portion 52, as well as the same components as the amplifier circuit 30 of the first embodiment. The PMOS transistor PTr4 is connected between the gate of the PMOS transistor PTr3 and the power supply voltage VDD, and the drive mode control signal Z is inputted to the gate of the PMOS transistor PTr4. When the drive mode control signal Z indicates the stopped mode (e.g., the drive mode control signal Z is in low level), the PMOS transistor PTr4 becomes the conducting state, and brings the PMOS transistor PTr3 firmly to the cutoff state.

The current control portion 52 has NMOS transistors NTr5-NTr7, and a PMOS transistor PTr6. The NMOS transistor NTr5 and PMOS transistor PTr5 are connected in series with each other. The gates of the NMOS transistor NTr5 and PMOS transistor PTr5 are connected with each other, and the drive mode control signal Z is inputted to them. Furthermore, the source of the PMOS transistor PTr5 is connected to the power supply voltage VDD. The NMOS transistor NTr6 is connected between the source of the NMOS transistor NTr5 and the ground voltage GND. The drive mode control signal ZB is inputted to the gate of the NMOS transistor NTr6.

The PMOS transistor PTr6 and NMOS transistor NTr7 are connected in series between the power supply voltage VDD and ground voltage GND. The gate of the PMOS transistor PTr7 is connected to the node between the PMOS transistor PTr5 and NMOS transistor NTr5. The gate and drain of the NMOS transistor NTr7 are connected with each other, and also connected to the gates of the NMOS transistor NTr3 and NTr4. Furthermore, the node between the PMOS transistor PTr6 and NMOS transistor NTr7 is connected to the node between the NMOS transistor NTr5 and NMOS transistor NTr6.

The operation of the current control portion 52 is explained hereinafter. Firstly, a case where the drive mode control signal Z is in high level and the drive mode control signal ZB is in low level is explained hereinafter. In this case, the PMOS transistor PTr5 and NMOS transistor NTr6 become the non-conducting states. Furthermore, the NMOS transistor NTr5 becomes the conducting state. Consequently, the gate of the PMOS transistor PTr6 is connected to the drain of the PMOS transistor PTr6 through the NMOS transistor NTr5, and the PMOS transistor PTr6 acts as a diode. Therefore, current flows through the NMOS transistor NTr7 based on the resistance (on-resistance) of the PMOS transistor PTr6 in the conducting state and the voltage of the power supply voltage VDD. Furthermore, the NMOS transistor NTr7 and the NMOS transistors NTr3 and NTr4 constitute a current mirror circuit with their connections. Therefore, the substantially same amount of current flows through the NMOS transistors NTr3 and NTr4 as the current flowing through the NMOS transistor NTr7. The amplifier circuit 50 operates based on this current.

Meanwhile, a case where the drive mode control signal Z is in low level and the drive mode control signal ZB is in high level is explained hereinafter. In this case, the PMOS transistor PTr5 and NMOS transistor NTr6 become the conducting states. Furthermore, the NMOS transistor NTr5 becomes the non-conducting state. Consequently, potential at the gate of the PMOS transistor PTr6 becomes the power supply voltage VDD, and the PMOS transistor PTr6 becomes non-conducting state. Furthermore, voltage at the drain of the NMOS transistor NTr7 becomes the ground voltage GND. Therefore, no current flows through the NMOS transistor NTr7. Furthermore, since voltage at the drain of the NMOS transistor NTr7 becomes the ground voltage GND, voltages at the gates of NMOS transistors NTr3 and NTr4 also become the ground voltage GND. Therefore, current supply to the amplifier circuit 50 is cut off, and the amplifier circuit 50 becomes the stopped state.

As explained above, in the driving circuit 16' in accordance with the second embodiment, supply current to the amplifier circuit 50 is cut off, and the output of the DAC 15 is outputted to drive pixels in low power mode LPM. Meanwhile, in the driving circuit 16 in accordance with the first embodiment, some current is supplied to the amplifier circuit 30 even in the low power mode LPM so that it continues operation in the low power mode. Accordingly, the driving circuit 16' in accordance with the second embodiment can reduce the power consumption in the low power mode LPM more than the driving circuit 16 in accordance with the first embodiment can do. That is, the display control device 2 in accordance with the second embodiment can reduce the power consumption more than the display control device 1 in accordance with the first embodiment can do.

Incidentally, the present invention is not limited to the above-described embodiments, and various modifications can be made to the embodiments without departing from the spirit and scope of the present invention. For example, the difference values between pixels that are driven at that moment and pixels that are driven at previous timing may be calculated by a separate calculation circuit or the like, rather than the difference circuit, and then the calculation results may be added to the display data that is inputted to the display control device. In this case, the display data may have, for example, 12 bits, and the uppermost three bits may be used as the difference value data. Then, the drive mode control circuit determines the driving period based on the values of these uppermost three bits. In other words, the calculation of the difference between pixel values is not limited to the method or component of the above-described embodiments, and may be carried out by using any other device, provided that the operation mode of the driving circuit is changed based on the difference between pixel values. Furthermore, the combination of the drive mode control circuit and the driving circuit of the above-described embodiment may be also modified without departing from the spirit and scope of the present invention.

It is apparent that the present invention is not limited to the above embodiments, but may be modified and changed without departing from the scope and spirit of the invention.

What is claimed is:

1. A display control device, comprising:

a driving circuit driving pixels based on successively inputted display data; and a drive mode control circuit determining an operation mode of the driving circuit based on a difference in value between first display data among the successively inputted display data and second display data among the successively inputted display data, the first display data comprising display data in an (N+1)th row, and the second display data comprising display data in an Nth row, wherein the drive mode control circuit counts clocks of an externally inputted clock signal, and wherein the drive mode control circuit determines a time ratio between one duration and another duration in a period during which a driving of one row of pixels is carried out, based on the difference in value, the driving circuit operating in the first mode during the one duration in the period and operating in the second mode during the another duration in the period.

2. The display control device according to claim 1, wherein the driving circuit comprises a first mode and a second mode, the pixels being driven with a first current driving capacity in the first mode and a second current driving capacity in the second mode.

3. The display control device according to claim 2, wherein the driving circuit drives the pixels with a higher current driving capacity in the first mode and a lower current driving capacity in the second mode.

4. The display control device according to claim 1, wherein the drive mode control circuit determines a time ratio between a duration located in a first half portion and a duration located in a second half portion in a period during which a driving of one row of pixels is carried out, based on the difference in value, the driving circuit operating in the first mode during the duration located in the first half portion and operating in the second mode during the duration located in the second half portion.

5. The display control device according to claim 4, wherein the driving circuit drives the pixels with a higher current driving capacity in the first mode and a lower current driving capacity in the second mode.

6. The display control device according to claim 1, wherein the driving circuit drives the pixels with a higher current driving capacity in the first mode and a lower current driving capacity in the second mode.

7. The display control device according to claim 1, wherein the drive mode control circuit selects a time ratio between one duration and another duration in a period during which the driving of one row of pixels is carried out, from a pre-established drive time table based on the difference in value, the driving circuit operating in the first mode during the one duration in the period and operating in the second mode during the another duration in the period.

8. The display control device according to claim 7, wherein the driving circuit drives the pixels with a higher current driving capacity in the first mode and a lower current driving capacity in the second mode.

9. The display control device according to claim 1, wherein the driving circuit changes an amount of current used in an operation of the driving circuit based on an operation mode determined by the drive mode control circuit.

10. The display control device according to claim 1, wherein the driving circuit comprises a buffer circuit to amplify the display data, and a switch to output the display data without passing the display data through the buffer circuit, and wherein the switch is in a cutoff state and the display data is outputted through the buffer circuit in the first mode, and the buffer circuit is in a stopped state and the display data is outputted through the switch in the second mode.

11. A method of controlling a display control device comprising a driving circuit to drive pixels arranged in a row direction of a display device comprising pixels arrange in a lattice pattern, the method comprising:

determining an operation mode of the driving circuit based on a difference in value between first display data among display data and second display data among the display data, the first display data comprising display data in an (N+1)th row, and the second display data comprising display data in an Nth row;

counting clocks of an externally inputted clock signal; and determining a time ratio between one duration and another duration in a period during which a driving of one row of pixels is carried out, based on the difference in value, the driving circuit operating in the first mode during the one duration in the period and operating in the second mode during the another duration in the period.

12. A display apparatus, comprising:

a driving circuit configured to drive a row of pixels of the display apparatus; and a drive mode control circuit configured to determine an operation mode, the operation mode including a first mode and a second mode, the determination being based on a difference between a value of the first data and a value of the second data, the first data comprising display data for a row of pixels in a next period of time after a current period of time being driven by the driving circuit, and the second data comprising display data for the current period of time for the row of pixels being driven by the driving circuit, wherein the drive mode control circuit comprises a difference extracting circuit, the difference extracting circuit configured to output a value based on a difference between the display data for the next period of time and the current period of time for the row of pixels being driven by the driving circuit, wherein the drive mode control circuit further comprises:

a register to store the output value from the difference extracting circuit; and a counter configured to count clocks of a display clock when a pulse of a synchronizing signal is input and to change an output signal based on the value stored in the register, and wherein the counter is configured to divide the value stored in the register by a gray-scale level to calculate a coefficient and to calculate a product of the coefficient and a number of clocks of a display clock that are inputted within an interval between the pulses of the synchronizing signal, and to then change the output signal when a count value of the inputted display clock exceeds the count clock value.

13. The display apparatus according to claim 12, wherein the first mode is a high power mode, and wherein the second mode is a low power mode.

14. The display apparatus according to claim 12, further comprising:

a data register configured to store the first data; and a data latch configured to store the second data.

* * * * *